US009427790B2

(12) United States Patent
Menendez-Castanedo et al.

(10) Patent No.: US 9,427,790 B2
(45) Date of Patent: Aug. 30, 2016

(54) METHOD FOR FORMING A WORKPIECE

(75) Inventors: Diego Castro Menendez-Castanedo, Gijon (ES); Juan Ignacio Lopez Martinez, Oviedo (ES); Ivan Jose Presa Lopez, Oviedo (ES)

(73) Assignee: PMG Asturias Powder Metal S.A.U., Mieres (ES)

( * ) Notice: Subject to any disclaimer, the term of this patent is extended or adjusted under 35 U.S.C. 154(b) by 460 days.

(21) Appl. No.: 14/005,261

(22) PCT Filed: Nov. 11, 2011

(86) PCT No.: PCT/IB2011/002950

§ 371 (c)(1),
(2), (4) Date: Sep. 14, 2013

(87) PCT Pub. No.: WO2012/063130

PCT Pub. Date: May 18, 2012

(65) Prior Publication Data

US 2014/0020442 A1 Jan. 23, 2014

(30) Foreign Application Priority Data

Nov. 12, 2010 (AT) ..... GM698/2010

(51) Int. Cl.
*B21D 22/00* (2006.01)
*B21D 31/00* (2006.01)
(Continued)

(52) U.S. Cl.
CPC ..... *B21D 31/00* (2013.01); *B21J 5/12* (2013.01); *B21J 13/025* (2013.01); *B21K 1/30* (2013.01);
(Continued)

(58) Field of Classification Search
CPC ..... B21D 31/00; B21J 5/12; B21J 13/025; B21K 1/30; B22F 3/24; B22F 5/08; B22F 2003/031; B22F 2003/245
USPC ..... 72/352, 353.2, 353.6, 354.2, 354.6, 72/358, 359, 399, 467
See application file for complete search history.

(56) References Cited

U.S. PATENT DOCUMENTS 874,448 A 12/1907 Smith
1,935,965 A 11/1933 Wahlberg
(Continued)

FOREIGN PATENT DOCUMENTS

CN 101 060 949 12/2004
DE 22 12 512 A1 10/1973
(Continued)

OTHER PUBLICATIONS

International Searching Authority; International Search Report of the International Searching Authority; International Application No. PCT/IB2011/002950; Patent Cooperation Treaty; pp. 1-3; publisher European Patent Office; Published Netherlands, Netherlands; copyright and mailing date Oct. 5, 2012; copy enclosed (3 pages).
(Continued)

*Primary Examiner* — David B Jones
(74) *Attorney, Agent, or Firm* — Metz Lewis Brodman Must O'Keefe LLC

(57) ABSTRACT

The invention relates to a method for forming a surface relief on an available surface of a compacted sintered component which forms the workpiece, using a forming element that is moved in the working direction towards the available surface. The working direction runs radially in relation to the workpiece and a contact surface of the forming element. The shape of the surface having the relief is applied to the surface of the workpiece in the working direction.

20 Claims, 11 Drawing Sheets

(51) Int. Cl.

| | |
|---|---|
| ***B21J 5/12*** | (2006.01) |
| ***B21J 13/02*** | (2006.01) |
| ***B21K 1/30*** | (2006.01) |
| ***B22F 3/24*** | (2006.01) |
| ***B22F 5/08*** | (2006.01) |
| *B22F 3/03* | (2006.01) |

(52) U.S. Cl.
CPC . *B22F 3/24* (2013.01); *B22F 5/08* (2013.01); *B22F 2003/031* (2013.01); *B22F 2003/245* (2013.01)

(56) References Cited

U.S. PATENT DOCUMENTS

| | | | | |
|---|---|---|---|---|
| 3,406,555 | A * | 10/1968 | Fuchs, Jr. | B21K 1/76 72/354.2 |
| 3,803,896 | A | 4/1974 | Cermak et al. | |
| 3,842,646 | A * | 10/1974 | Kuhn | 72/354.8 |
| 4,111,031 | A * | 9/1978 | Vennemeyer et al. | 72/359 |
| 4,296,180 | A * | 10/1981 | Rhau | B21K 21/06 102/474 |
| 4,523,445 | A * | 6/1985 | Yoshida | B21K 29/00 72/342.8 |
| 6,044,684 | A * | 4/2000 | Ohama et al. | 72/354.2 |
| 7,967,685 | B2 * | 6/2011 | Suzuki | 464/145 |
| 8,413,479 | B2 * | 4/2013 | Knott | 72/352 |
| 8,806,912 | B2 * | 8/2014 | Chiesa et al. | 72/352 |
| 2007/0221005 | A1 * | 9/2007 | Geiman | 74/459.5 |
| 2010/0035077 | A1 * | 2/2010 | Chiesa et al. | 428/546 |
| 2010/0064755 | A1 | 3/2010 | Koller et al. | |
| 2010/0227695 | A1 * | 9/2010 | Suzuki | 464/141 |
| 2011/0232092 | A1 | 9/2011 | Mueller et al. | |

FOREIGN PATENT DOCUMENTS

| | | | |
|---|---|---|---|
| DE | 119358 | | 4/1976 |
| DE | 25 17 039 | A1 | 10/1976 |
| DE | 196 04 386 | A1 | 8/1996 |
| EP | 0 370 562 | A2 | 5/1990 |
| EP | 0 584 907 | A2 | 3/1994 |
| EP | 2 060 346 | A2 | 5/2009 |
| JP | S59-62834 | U | 4/1984 |
| JP | S63-119944 | A | 5/1988 |
| JP | H02-169129 | A | 1/1990 |
| JP | 2 200341 | A | 8/1990 |
| JP | 7 051896 | A1 | 2/1995 |
| JP | 7 075300 | A | 3/1995 |
| SU | 990424 | | 1/1983 |
| SU | 1382573 | | 3/1988 |
| WO | WO 2005/053875 | | 6/2005 |
| WO | WO 2010/075600 | | 7/2010 |

OTHER PUBLICATIONS

Austria Patent Office; Search Report of the Austrian Patent Office; Austrian Patent Application No. GM 698/2010; Austrian Patent Office; pp. 1-2; publisher Austrian Patent Office; Published Austria; copyright and mailing date Jul. 7, 2011; copy enclosed (2 pages).
International Searching Authority; Written Opinion of the International Searching Authority; International Application No. PCT/IB2011/002950; Patent Cooperation Treaty; pp. 1-12; publisher European Patent Office; Published Netherlands, Netherlands; copyright and mailing date Jun. 25, 2013; copy enclosed (12 pages).
Search Report; State Intellectual Property Office of P.R.C., Application No. 201180054552.5, Jul. 25, 2014, translation supplied by SIPO.

* cited by examiner

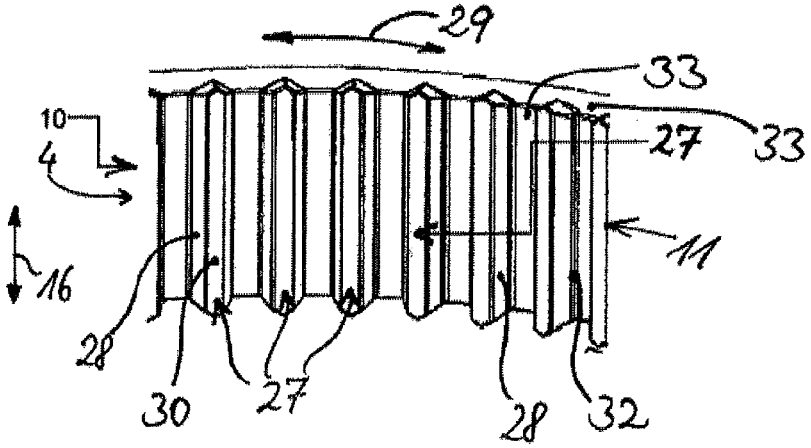
Fig. 6
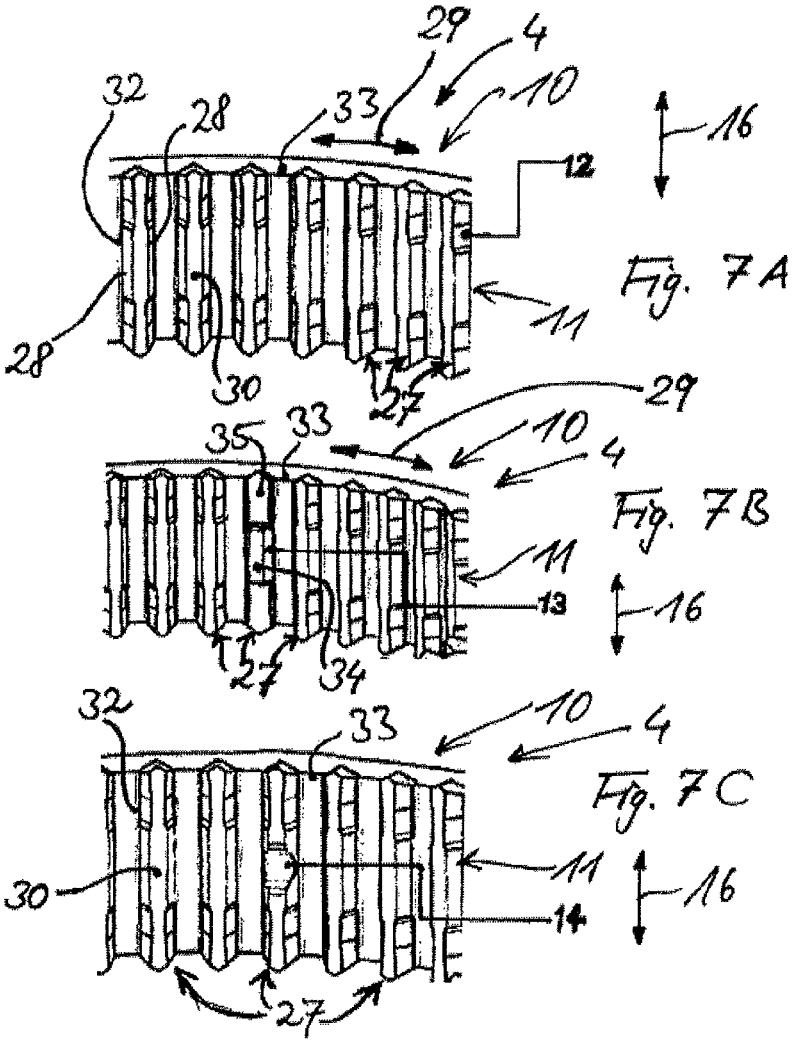
Fig. 7A
Fig. 7B
Fig. 7C

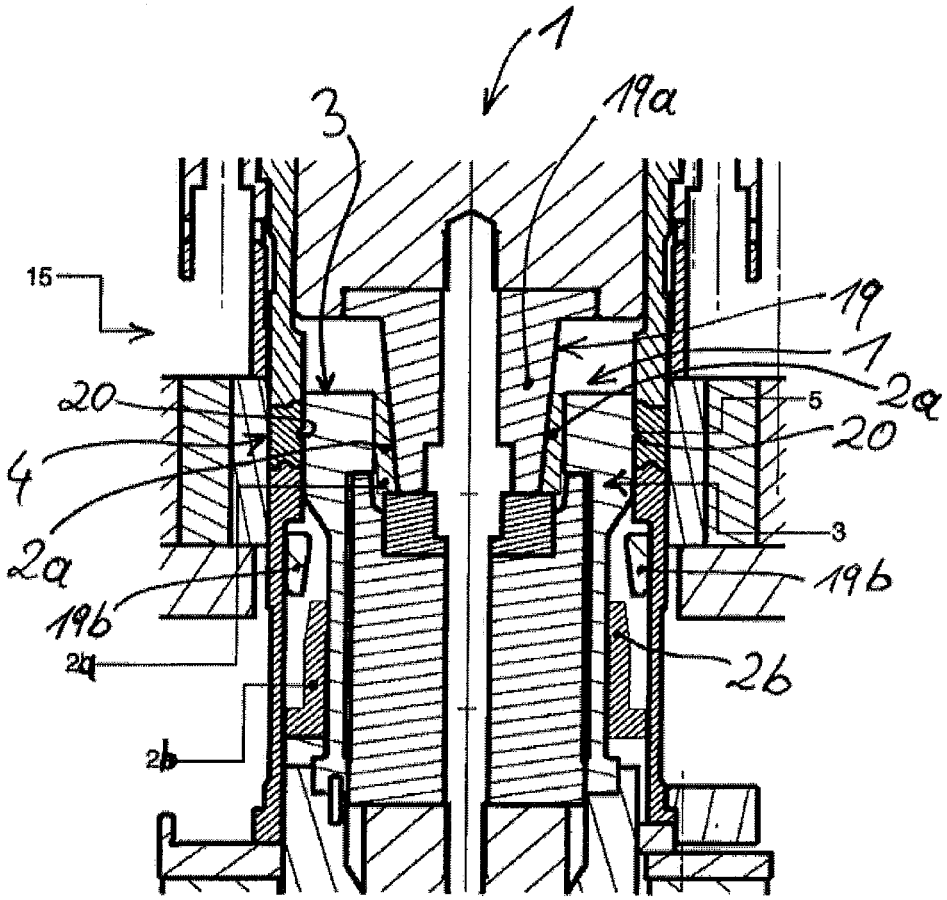
Fig. 17
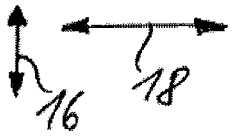

METHOD FOR FORMING A WORKPIECE

CROSS REFERENCE TO RELATED APPLICATIONS

This application claims priority from previously filed PCT application number PCT/IB2011/002950 filed on Nov. 11, 2011 which claims priority from GM 698/2010 filed Nov. 12, 2010.

STATEMENT REGARDING FEDERALLY SPONSORED RESEARCH OR DEVELOPMENT

N/A

BACKGROUND

The invention relates to a method for forming a workpiece.

WO 2010/075600 A1 discloses a method for forming undercuts on the internal toothing system of a sliding sleeve produced by powder metallurgy for a shift transmission. In this case, recesses in the region of the tooth flanks of the internal toothing system of annular components are denoted as undercuts. The forming is effected with the aid of a rolling tool, the undercuts being formed by backrolling with plastic material displacement from the undercut region. On account of the rotary motions of the rolling tool along the surface of the workpiece for a predefined number of tool revolutions, there is the risk that the workpiece will be mechanically deformed.

A tool for compacting a sintered component or for compacting a powder for the sintered component to be produced can be gathered from EP 2 060 346 A2. The tool has a compacting element which can be varied in terms of its radial dimensions and with the aid of which a sintered component in the form of a simple ring or the toothing system of a sintered component or a sintered powder is compacted.

DE 2 212 512 A1 describes a method and an apparatus for forming locks in internal toothing systems of displaceable sleeves. Here, what are known as forming jaws of the apparatus are displaced radially and achieve cold pressing in the internal toothing system. Upon pressing, excess material is pressed into the tooth root and the tooth tip of the teeth.

SUMMARY

The invention is based on the object of processing an available surface of a workpiece cost-effectively and at the same time in a dimensionally stable manner by forming.

This object is achieved by the subjects of the patent claims.

Provision is made of a forming element, which is moved simply along a working direction toward an available surface of a compacted sintered component as a workpiece and acts with a shaped relief of a contact surface of the forming element upon the surface of the workpiece in the working direction. The forming element is moved in the working direction not for instance in rotation, but rather at least substantially in a translatory manner along a radial direction in relation to the workpiece, so that with little exertion of force a good degree of efficiency is achieved when forming the desired surface relief, which is predefined by the shaped relief of the contact surface of the forming element.

For understanding the method, it should be understood that the shaped relief of the forming element is formed non-complementarily in relation to the available surface of the already compacted sintered component. It is preferable that the component produced by sintering has also already been calibrated.

The forming on the compacted sintered component allows for a time-saving production of the desired surface relief or of the desired final geometry of the workpiece compared to conventional methods such as rolling or reworking by milling. In addition, a considerably larger number of different and complicated relief geometries can be realized on the workpiece surface with the invention, since they can be predetermined as a negative relief and do not initially have to be produced by laborious reworking.

In addition, the method according to the invention avoids the disruptive formation of burrs on the workpiece surface, which likewise does away with high-cost reworking steps. The sleeve disclosed in DE 2 212 512 A1 consists of solid material, and therefore excess material is pressed into the tooth root and the tooth tip upon pressing. This creates burr, which subsequently has to be processed and removed. In addition, the formation of burrs and the removal thereof has to be taken into consideration when dimensioning the toothing system. According to the invention, these method steps are avoided in that a sintered component produced by sintering and thereby having porosity is used as the workpiece. Upon forming, excess material can therefore be pressed into the pores of the sintered component. In this way, individual surface regions of the surface relief to be formed are not impaired by excess material or the formation of burrs. A high-quality and dimensionally accurate production even of complex geometries of a surface relief is thereby made possible (e.g. recesses in the region of a tooth tip and/or of a tooth root of a tooth of the internal or external toothing system of a sliding sleeve, in particular for motor vehicles). By contrast, in the case of the workpiece made of solid material as per DE 2 212 512 A1, merely the flanks of the teeth can be formed, since the excess material already impairs the tooth roots and the tooth tips upon forming.

The pressing of excess material into the pores of the sintered component in the region of a surface relief when forming a predefined surface relief has the further advantage that this region can be afforded improved protection against damage and wear. The service life of the sintered component can thereby be increased without additional costs.

Measures of the design make it possible to easily adapt the way in which the method is carried out to annular workpieces, e.g. toothed wheels or sliding sleeves for the automotive sector. In addition, by means of the radially variable extent of the forming element, mechanical engagement of the forming element with the workpiece and also the release of this engagement can be realized in a technically simple manner as the method is being carried out.

On account of the principle of the method, defined final geometries can be realized both on radially inner and also on radially outer surfaces of, in particular, annular workpieces. The available radially inner or outer surfaces can also have interruptions (e.g. indentation, groove, or the like).

It is advantageous that the surface relief is formed on individual teeth or all teeth of a toothing system (in particular of an internal or external toothing system) of a workpiece, so that the final geometry of the workpiece can be manufactured in a particularly cost-effective and dimensionally accurate manner.

A preferred application of the method is therefore the production of toothed wheels, sliding sleeves, synchronizer rings and coupling bodies for automotive construction, in particular for shift transmissions of motor vehicles.

A desired surface relief can be produced at low cost on a toothing system (in particular a toothing system of a sliding sleeve) by means of forming. On account of the porosity of the workpiece produced as a sintered component, in particular of a sliding sleeve, excess material which forms upon forming can be absorbed by the pores, and therefore the teeth of the toothing system can be formed in a dimensionally stable manner in all surface regions, i.e. also in the region of the tooth tip and of the tooth root.

The surface relief to be formed on a tooth is preferably provided on a lateral tooth flank facing toward an adjacent tooth in the circumferential direction and/or on a radially outer tip region and/or on a root region adjoining the main body of the compacted sintered component of the tooth.

Recesses can be formed on the teeth of the toothing system, i.e. material is displaced on the teeth by forming. The recesses can advantageously form undercuts, stops or stop teeth or latching grooves on teeth of the toothing system.

Surface reliefs of this type, such as undercuts, latching grooves or stop teeth, are conventionally produced on the teeth of the toothing system often in a complicated manner by milling, rolling or reworking of another type. In addition, the conventional reworking is associated with restrictions for configuring the relief on the toothing system, whereas the forming proposed according to the invention permits any desired surface reliefs in all surface regions (in particular tip region, side flanks, root region) of the teeth.

The surface reliefs can have, for example, undercuts and/or latching grooves and/or stop teeth. It is conventional that a plurality of processing steps have to be carried out on a tooth, if for example an undercut and a latching groove, i.e. a plurality of relief types, are provided on this tooth. By means of the forming, these different relief types can also be realized on the teeth of the toothing system intended therefor with an appropriately configured shaped relief in a single working step saving time and cost.

Mechanically controlling the movement of the forming element by means of a drive element which can move transversely to the working direction of said forming element along a drive direction makes it possible to achieve a defined transmission of force to the surface of the workpiece, and consequently promotes a dimensionally stable final geometry of the workpiece.

Additional measures of the design improve the defined transmission of force to the workpiece.

Another feature of the design promotes defined mechanical coupling between the forming element and the other components of a drive tool as the method is being carried out.

The surfaces of the transfer element and of the forming element which are complementary to one another advantageously run parallel to the drive direction of the drive element. This geometry promotes a structurally simple design of the forming element and the cost-effective production thereof. In addition, the simple design of the forming element promotes the functionally reliable execution of the forming method.

Another feature of the design relates to a preferred embodiment of the transfer element which promotes the control of the movement of the forming element depending on the structural configuration thereof.

To achieve the object according to the invention, it is furthermore proposed to use a tool in order to form a surface relief on an available surface of a workpiece formed as a compacted sintered component. Here, the tool has a forming element, which can move in a radial working direction in the direction of the compacted sintered component and has a contact surface with a shaped relief. With this shaped relief, the tool acts upon the available surface of the compacted sintered component to be processed by forming in the working direction. Therefore, this tool contributes to processing available surfaces of already compacted sintered components (e.g. an internal toothing system or external toothing system of sliding sleeves for motor vehicles) cost-effectively by forming. In this case, a surface relief which is predefined by the shaped relief of the forming element is formed on the available surface.

BRIEF DESCRIPTION OF THE DRAWING

Hereinbelow, the invention will be explained in more detail with reference to the exemplary embodiments shown in the drawings, in which:

FIG. 6 shows a perspective partial illustration of a sliding sleeve having an internal toothing system available for forming, before the forming operation, FIGS. 7A, 7B, 7C show perspective partial illustrations of sliding sleeves having different surface reliefs on the internal toothing system after forming, FIG. 17 shows the sectional side view of the drive apparatus and of the tool as shown in FIG. 16 in a position during the forming of the workpiece.

Figure 1:
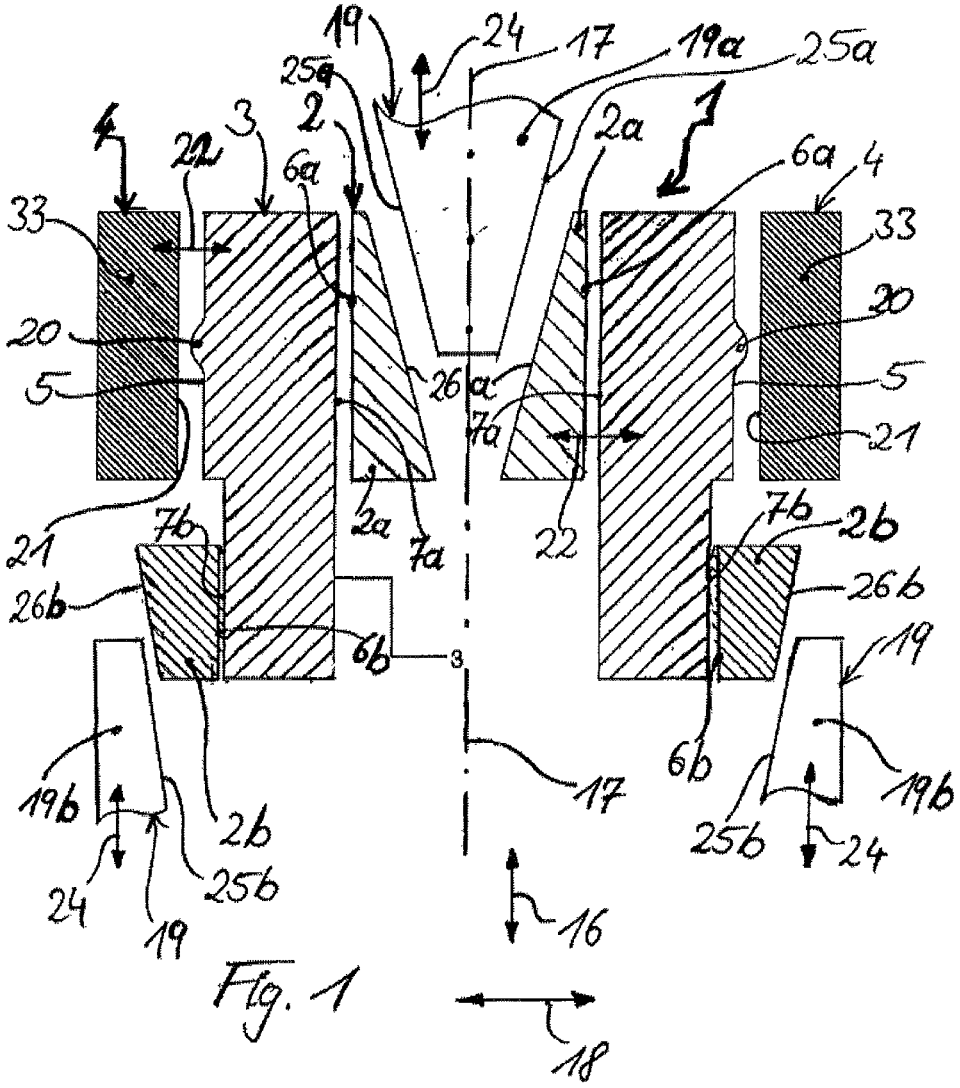
FIG. 1 shows a sectional schematic side view of the tool in a first embodiment.

The tool 1 for forming as shown in FIG. 1 has a transfer element 2 and a forming element 3. The transfer element 2 contains a first transfer element part 2*a* and a second transfer element part 2*b*. The two transfer element parts 2*a* and 2*b* are arranged at a distance from one another in the axial direction 16 of the tool 1, i.e. along a center longitudinal axis 17 of the tool 1. The forming element 3 can be varied in terms of its radial extent in the radial direction 18. To this end, the movement of individual or all transfer element parts 2*a*, 2*b* is controlled in the radial direction 18. This movement is controlled by means of an associated drive element 19*a*, 19*b*, which is shown merely schematically in FIG. 1.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

The forming element 3 bears a contact surface 5 with a shaped relief 20, which is intended to act upon an available radially inner surface 21 of the annular workpiece 4 for forming in the working direction 22. The workpiece 4 is in the form of a compacted sintered component. The working direction 22 runs substantially in the radial direction 18 of the workpiece 4. The shaped relief 20 is formed non-complementarily in relation to the inner surface 21 to be formed. In order to form the inner surface 21, the forming element 3 is moved by means of the drive element 19 and the transfer element 2 in the direction of its radially greatest extent (FIG. 1).

Figure 2:
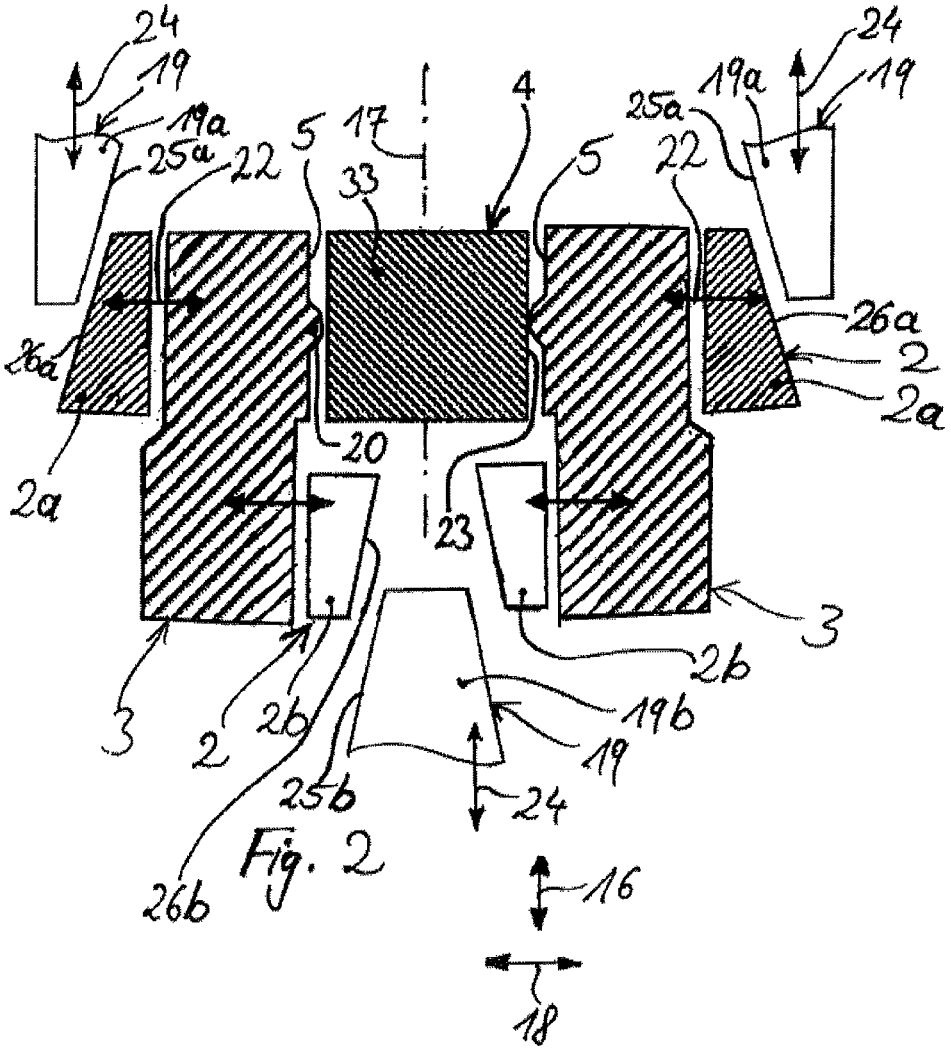
FIG. 2 shows a sectional schematic side view of the tool in a further embodiment.

For forming an available radially outer surface 23, the forming element 3 is moved by means of the drive element 19, 19*a*, 19*b* and the transfer element 2 in the direction of its radially smallest extent (FIG. 2).

For controlling the movement of the forming element 3, the drive element 19 is driven transversely to the working direction 22 along a drive direction 24. The drive direction 24 runs parallel to the axial direction 16. Surfaces of the drive element 19, of the transfer element 2 and of the forming element 3 which correspond to one another or interact with one another ensure the required transmission of force to the forming element 3, so that the latter can be transferred into its different positions before, during and after the forming, without there being any undesirable mechanical contacts between the forming element 3 and its shaped relief 20 and the workpiece 4. The drive element 19 has a drive surface 25*a*, 25*b*, which runs at an acute angle to the drive direction 24. The drive surface 25*a* interacts with a complementary transfer surface 26*a* of the transfer element 2*a*. The same applies for the drive surface 25*b* and a complementary transfer surface 26*b* of the transfer element 2*b*.

The transfer element 2 is arranged between the drive element 19 and the forming element 3. The transfer element 2*a* or 2*b* has a second transfer surface 6*a* or 6*b*, which interacts with a complementary bearing surface 7*a* or 7*b* of the forming element 3. The second transfer surfaces 6*a*, 6*b* and the bearing surfaces 7*a*, 7*b* run parallel to the drive direction 24 or in the axial direction 16.

At least one transfer element part 2*a*, 2*b* and/or the forming element 3 are preferably also movable in the axial direction 16.

The forming element 3 preferably has a substantially annular or hollow-cylindrical form. This can be best identified in FIG. 3 and FIG. 4. A multiplicity of slots 8 can be provided along the circumferential direction thereof. These allow for a simple, radially variable extent of the dimensions of the forming element 3. The forming element 3 can to some extent be "opened" (radial enlargement) and "closed" (radial reduction in size) in the radial direction 18.

Figure 5A:
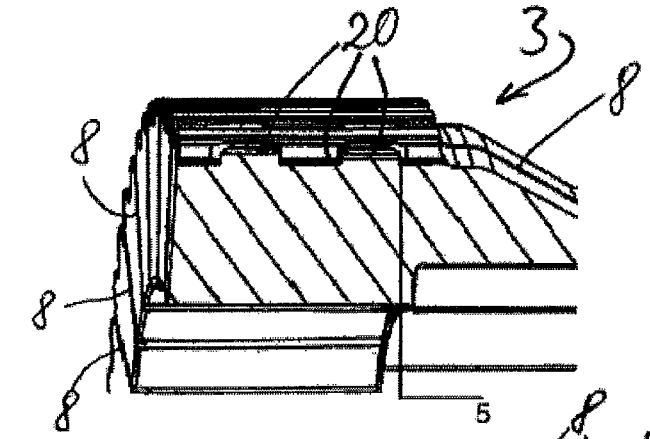
Figure 5B:
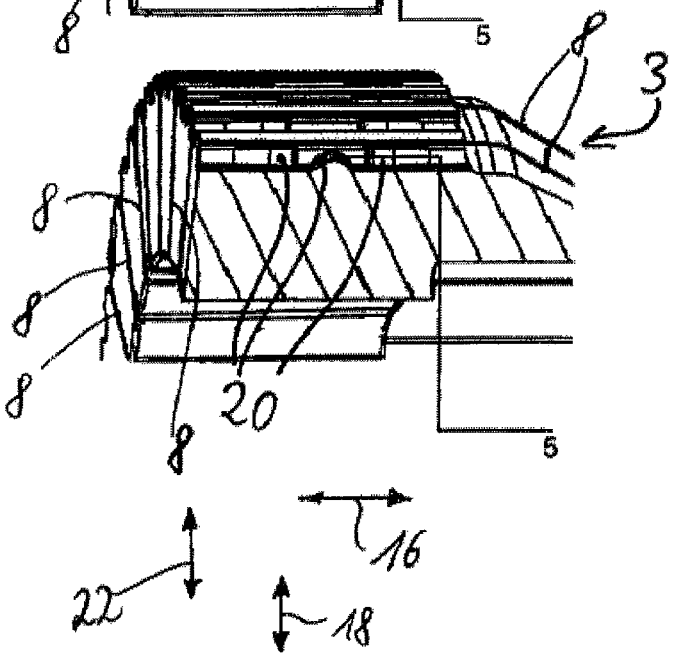

The forming element 3 provided with slots 8 as shown in FIGS. 5A, 5B is suitable for realizing radially inner final geometries on an inner surface 21 of the workpiece 4.

Figure 3:
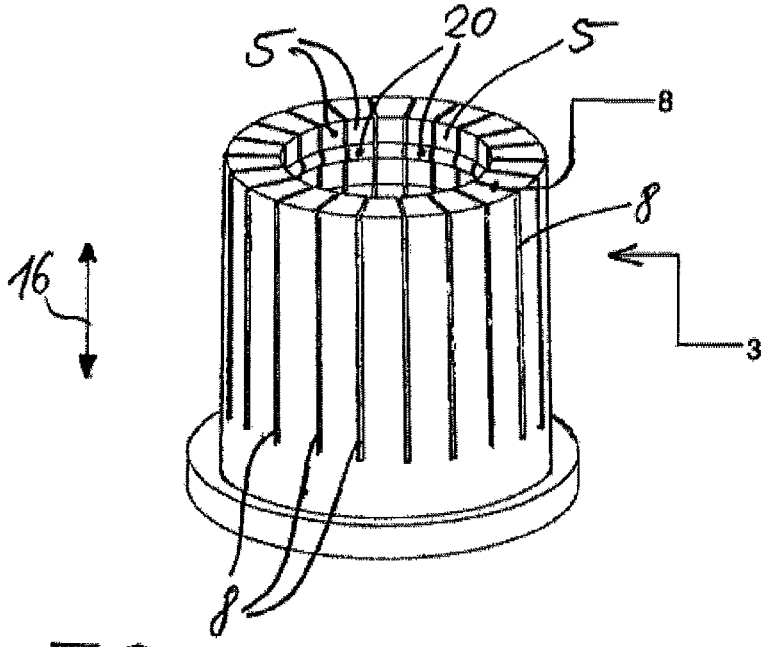
FIG. 3 shows a perspective view of the forming element in a first embodiment.
Figure 4:
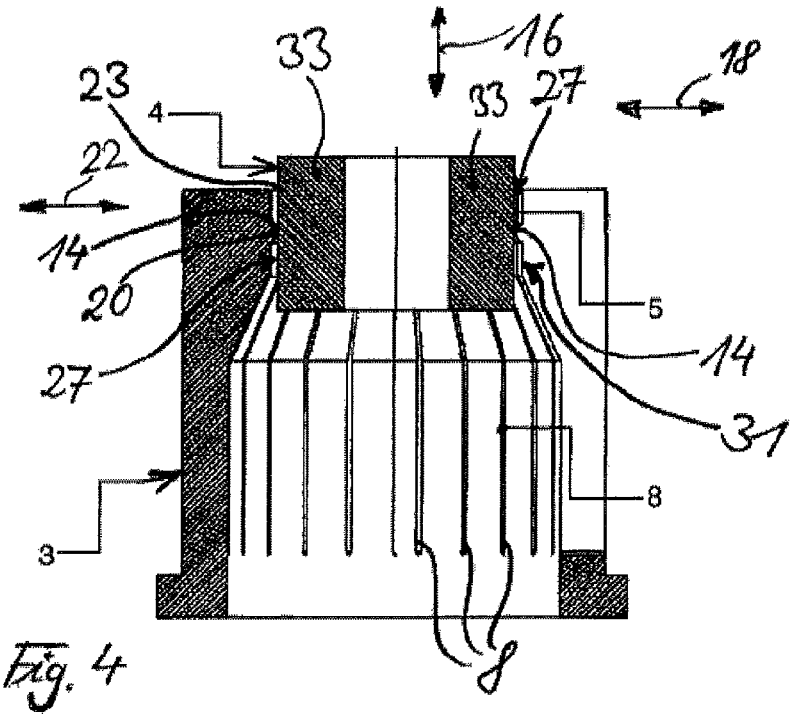
FIG. 4 shows a sectional side view of the forming element as shown in FIG. 3, FIGS. 5A, 5B show perspective partial illustrations of two forming elements having different shaped reliefs for forming the internal toothing system of a sliding sleeve.

The forming element 3 as shown in FIG. 3 and FIG. 4 is suitable for forming a radially outer surface 23 of a workpiece 4. The slots 8 are oriented in the radial direction 18, but they do not extend over the entire length of the forming element 3 in the axial direction 16. The available outer surface 23 can have an entirely cylindrical form in the circumferential direction 29, such that individual recesses can be formed by means of the shaped relief 20. Alternatively, the outer surface can have an external toothing system 31 with one or more teeth 27, as indicated schematically in FIG. 4. Individual recesses, e.g. latching grooves 14, can then be formed in these teeth 27 of the external toothing system 31 by means of the shaped relief 20.

In one embodiment, the available surface of the workpiece 4 is the still non-formed internal toothing system 11 of a sliding sleeve 10 (FIG. 6). The final geometry to be formed and the surface relief of the internal toothing system 11 to be formed are defined by the shaped relief 20 of the forming element 3 (FIGS. 5A, 5B). By means of the shaped relief 20 defined in each case, the internal toothing system 11 to be processed by forming can assume different final geometries: after forming, the internal toothing system or individual teeth 27 thereof can have, for example, the geometry and function of undercuts 12 (FIGS. 7A, 8B, 10B), of stop teeth 13 (FIGS. 7B, 14B) or of latching grooves 14 (FIGS. 7C, 12B, 12C, 12D).

Given an appropriate configuration of the forming element 3 (e.g. fundamentally as per FIGS. 2, 3, 4), individual teeth 27 of an external toothing system 31 can of course also have the aforedescribed final geometries or the final geometries still to be described hereinbelow.

Figure 8A:
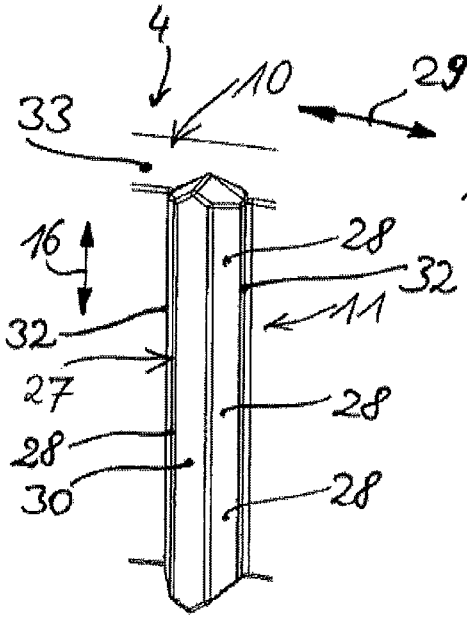
FIGS. 8A, 8B show a perspective illustration of a tooth of the internal toothing system of a sliding sleeve, before and after the forming of a surface relief.
Figure 8B:
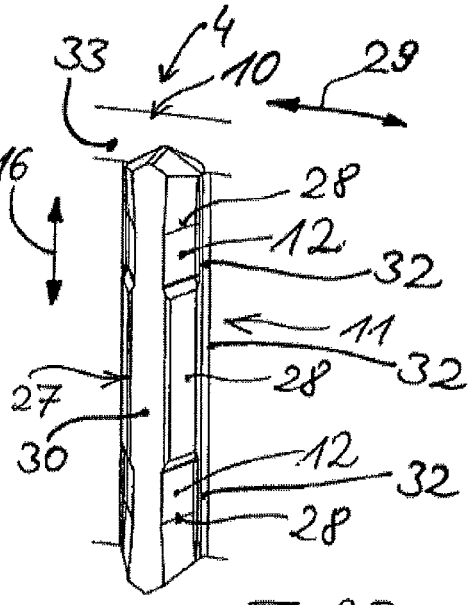
Figure 9:
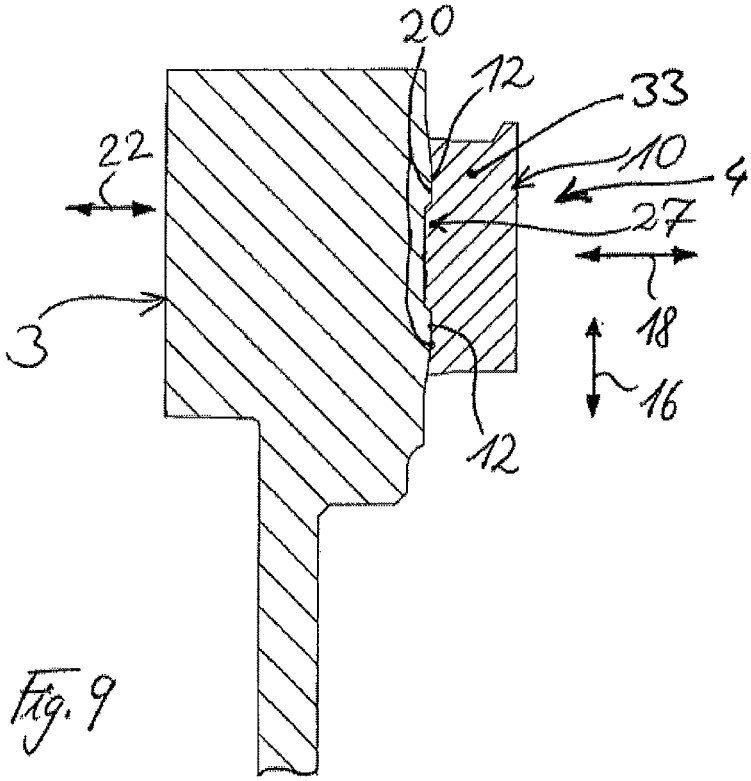
FIG. 9 shows a partial cross section of a forming element for forming the surface relief on the tooth as shown in FIG. 8B, FIGS. 10A, 10B show a perspective illustration of a tooth of the internal toothing system of a sliding sleeve, before and after the forming of a further embodiment of the surface relief.

FIG. 8B shows a first variant of an undercut 12 produced by forming on a tooth 27. The geometry of this undercut 12 corresponds substantially to the variant as shown in FIG. 7A. A forming element 3 which can be used for forming this undercut 12 is shown in FIG. 9 in the working position which brings about the forming.

The structure of a still non-formed tooth 27 of a toothing system is readily identifiable with reference to FIG. 8A. It has a radially oriented tip region 30. A root region 32 of the tooth is located lying radially opposite said tip region 30 and facing toward the main body 33 of the sintered component 4 or of the sliding sleeve 10. Two lateral tooth flanks 28 are arranged between the tip region 30 and the root region 32. In each case one tooth flank 28 faces toward a tooth 27 which is adjacent in the circumferential direction 29 of the sintered component 4.

In the embodiment of the tooth 27 as shown in FIG. 8A, in particular the two tooth flanks 28 and to a small extent preferably also the root region 32 are formed by means of the forming element 3 in such a manner that recesses in the form of undercuts 12 are formed on the tooth flanks 28 by means of the forming.

Figure 10A:
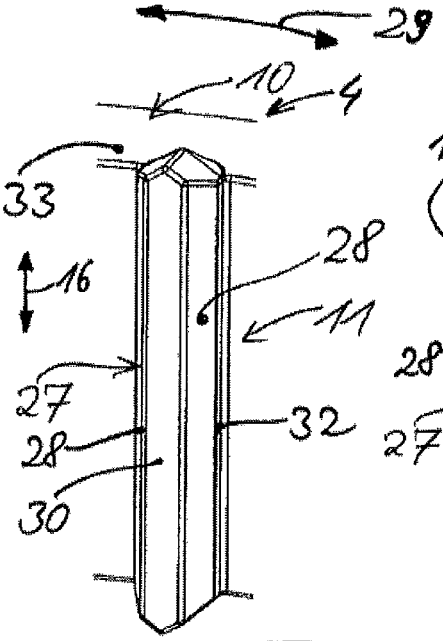
Figure 10B:
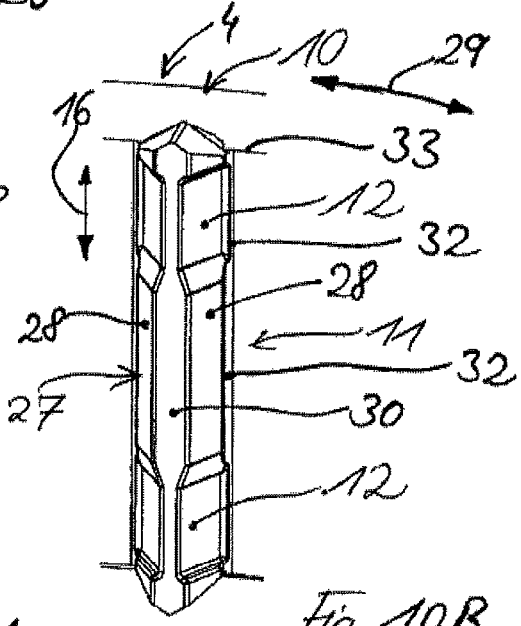
Figure 11:
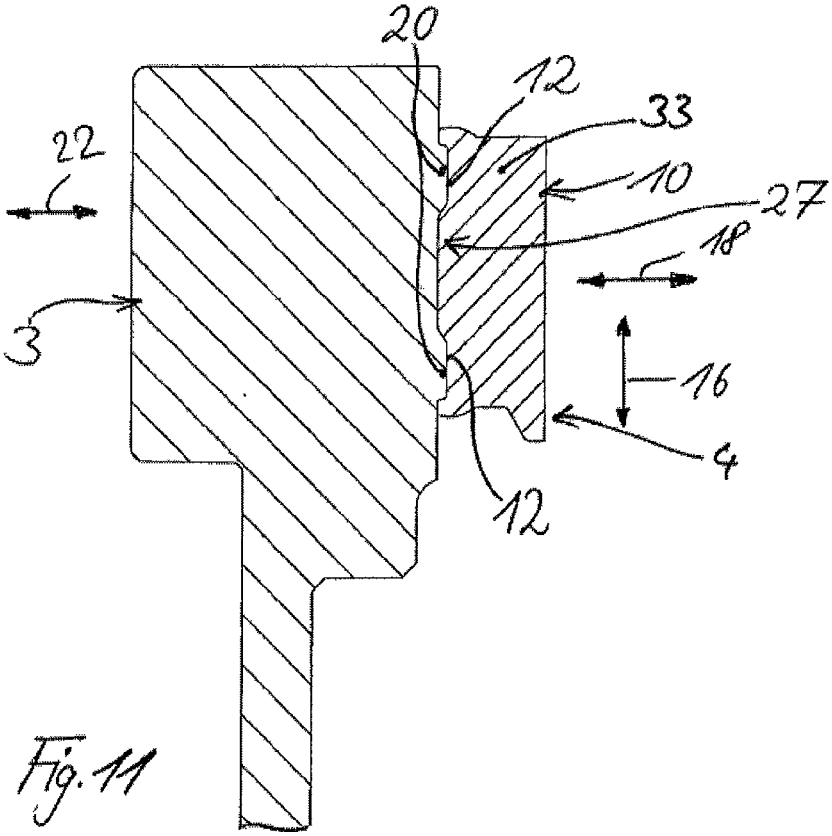
FIG. 11 shows a partial cross section of a forming element for forming the surface relief on the tooth as shown in FIG. 10B, FIGS. 12A, 12B show a perspective illustration of a tooth of the internal toothing system of a sliding sleeve, before and after the forming of a further embodiment of the surface relief.

FIG. 10B shows a further variant of an undercut 12 produced on a tooth 27 by forming the side flanks 28 and the root region 32. A forming element 3 which can be used for forming this undercut 12 is shown in figure in the working position which brings about the forming.

Figure 12A:
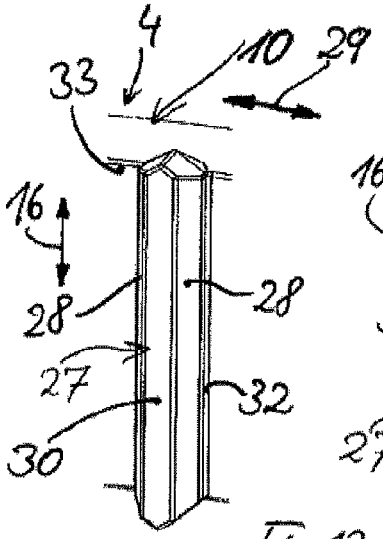
FIGS. 12C, 12D show perspective illustrations of teeth of the internal toothing system of a sliding sleeve, after the forming of further embodiments of the surface relief.
Figure 12B:
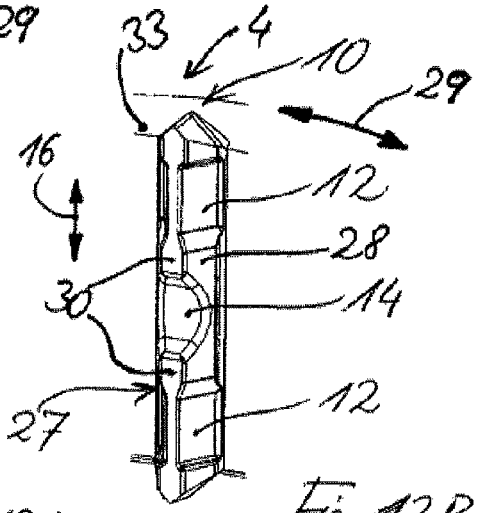
Figure 12C:
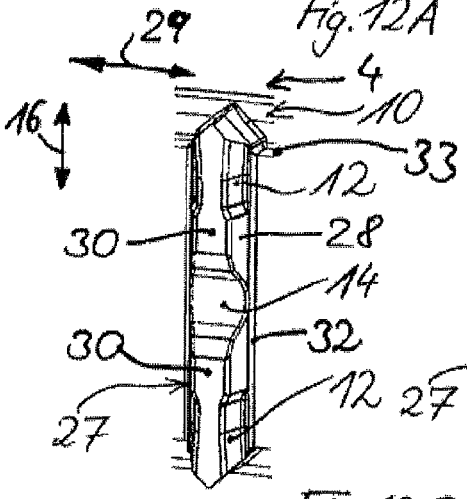
Figure 12D:
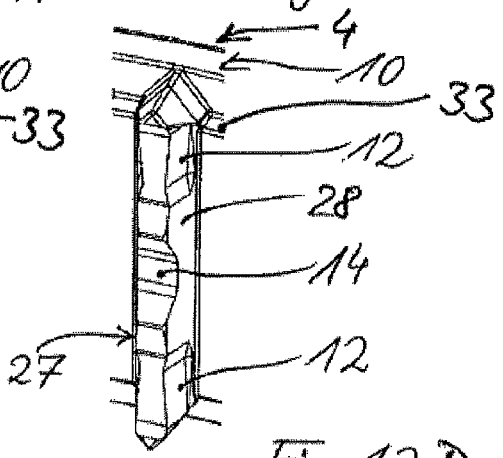
Figure 13:
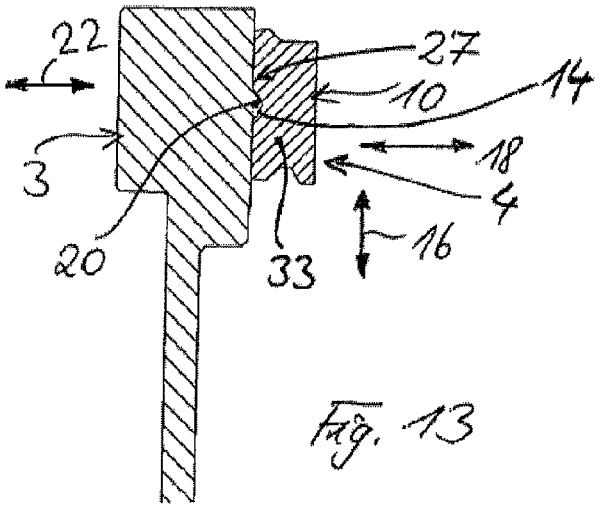
FIG. 13 shows a partial cross section of a forming element for forming the surface relief on the tooth as shown in FIG. 12B, FIGS. 14A, 14B show a perspective illustration of a tooth of the internal toothing system of a sliding sleeve, before and after the forming of a further embodiment of the surface relief.

FIGS. 12B, 12C and 12D show in each case a variant of a latching groove 14 produced on a tooth 27 by forming. The latching groove 14 forms a recess in the tip region 30 of the tooth 27. A forming element 3 which can be used in principle for forming these latching grooves 14 is shown in FIG. 13 in the working position which brings about the forming. The knob-like geometry of the shaped relief 20 for forming the latching groove 14 is in this case adapted in each case to the geometrical variant of the latching groove 14. Furthermore, it can be gathered from FIGS. 12B, 12C and 12D that the surface relief of the tooth 27 has both an undercut 12 and a latching groove 14. This surface relief can be formed by means of a single forming element 3. Alternatively, a plurality of, in particular two, forming elements 3 with a different shaped relief 20 can be used in succession, in order to form the entire surface relief (undercut 12 and latching groove 14) on the tooth 27.

Figure 14A:
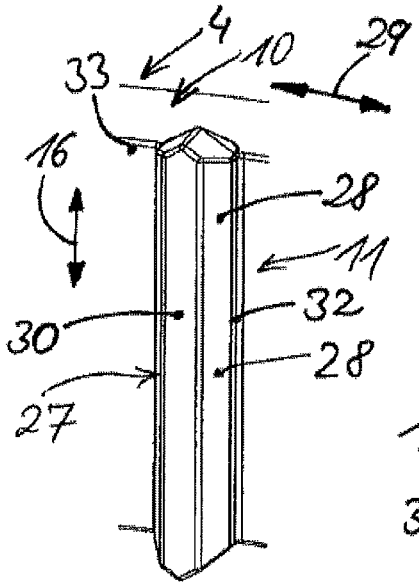
Figure 14B:
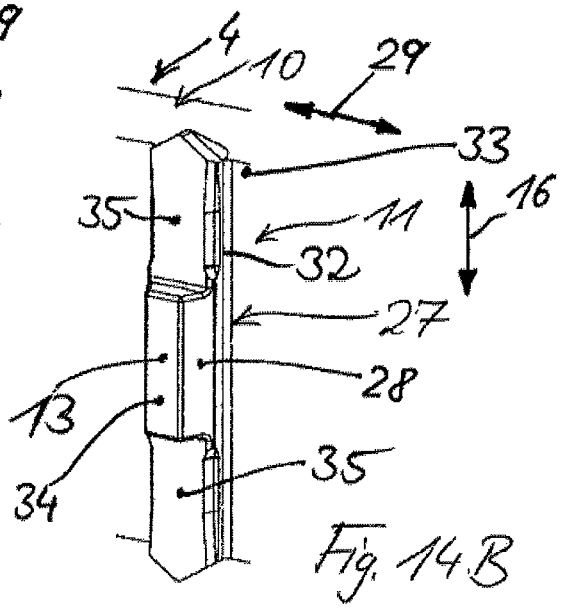
Figure 15:
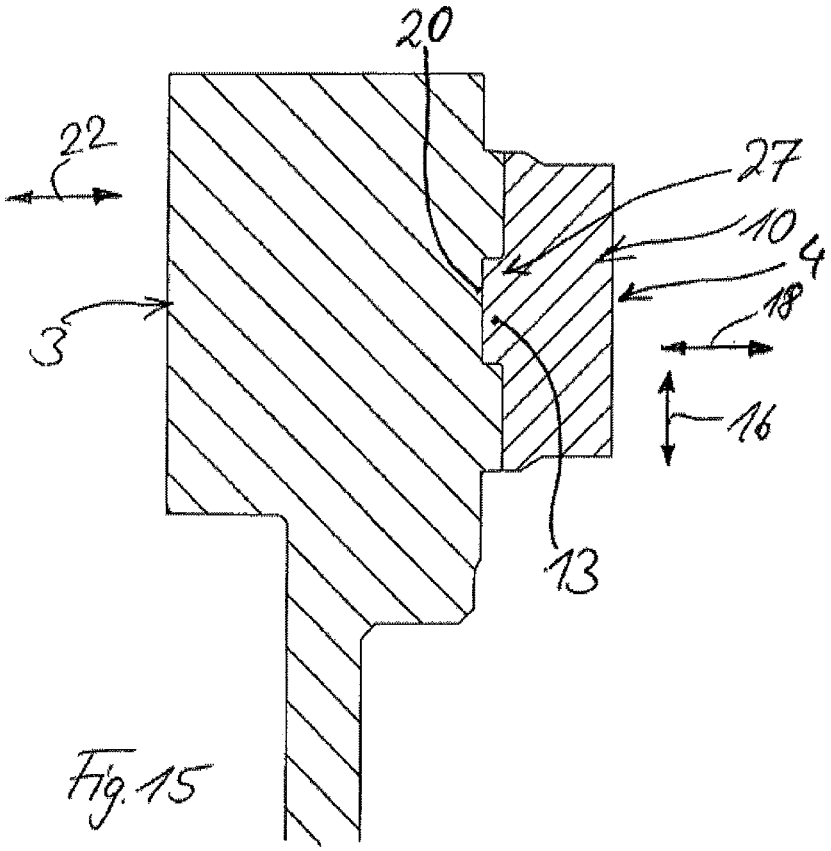
FIG. 15 shows a partial cross section of a forming element for forming the surface relief on the tooth as shown in FIG. 14B.

FIG. 14B shows what is known as a stop tooth 13 as a surface relief on a tooth 27. A forming element 3 which can be used for forming this stop tooth 13 is shown in FIG. 15 in the working position which brings about the forming. The stop tooth 13 is produced by acting upon in particular two tip portions 35 of the tip region 30 which are on the outside in the axial direction 16. It is preferable that in addition the two tooth flanks 28 and the root region 32 are acted upon to a smaller extent. The forming gives rise to a tip portion 34 which forms the actual stop tooth 13 and to the two outer tip portions 35 which flank the latter. As a result of the forming operation, the tip portion 34 on the one hand and the tip portions 35 on the other hand radially have an extent of differing length.

In principle, the forming elements 3 as shown in FIGS. 9, 11, 13, 15 can have the structural design as shown in FIG. 5A or 5B, but with a correspondingly adapted shaped relief 20.

Figure 16:
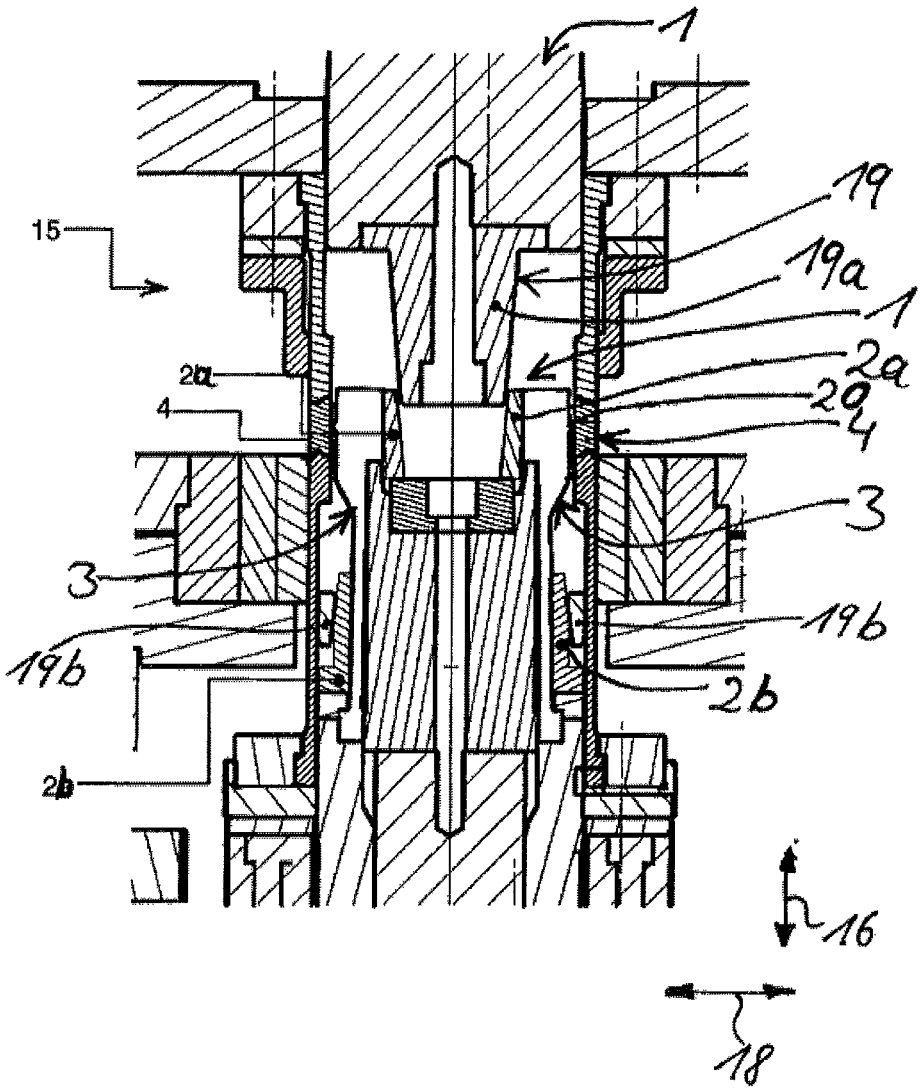
FIG. 16 shows a sectional side view of a drive apparatus for the tool in a position before the forming of the workpiece.

The drive element 19 and the parts 19*a*, 19*b* thereof and the tool 1 can be identified as component parts of a drive apparatus 15 in FIG. 16 and FIG. 17. The drive apparatus 15 can be configured differently and makes it possible for the forces required for controlling the movement of the forming element 3 to be transmitted. The structural configuration of the drive apparatus 15 ensures that the forming element 3 can be transferred into the desired position without undesirable contact between the shaped relief 20 thereof and the contact surface 5 thereof and the workpiece 4. In particular, the transfer element 2 or parts 2*a*, 2*b* thereof and/or the forming element 3 and/or the drive element 19 or parts 19*a*, 19*b* thereof can be moved in the axial direction 16 by means of the drive apparatus 15 as the method is being carried out.

In the case of a forming operation on an available radially inner surface 21 of a workpiece 4 formed as a compacted sintered component, the drive apparatus 15 reduces the radial extent of the forming element 3 by means of the transfer element 2*b* and transfers it into a starting position within the workpiece 4 at a radial distance from the inner surface 21 to be formed (FIG. 16). In addition, the forming element 3 is also transferred axially into the required position. Then, the drive apparatus 15 controls the transfer element 2*a* by means of the part 19*a* of the drive element 19 in such a manner that said transfer element increases the size of the radial extent of the forming element 3, in order to carry out the forming in a working position.

In the case of a forming operation on an available radially outer surface 23 of a workpiece 4, the drive apparatus 15 which is structurally correspondingly adapted if needed has the effect, by means of the transfer element 2*a* and/or 2*b*, that the forming element is initially radially enlarged and is transferred without contact with the workpiece 4 into a starting position, in which the shaped relief 20 and the contact surface 5 surround the radially outer surface 23 of the workpiece 4 at a radial distance. In addition, the forming element 3 is also transferred axially into the required position. Then, the drive apparatus 15 controls the transfer element 2*a* and/or 2*b* in such a manner that said transfer element reduces the size of the radial extent of the forming element 3, in order to carry out the forming in a working position.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

LIST OF REFERENCE SIGNS

1 Tool
2, 2*a*, 2*b* Transfer element
3 Forming element
4 Workpiece
5 Contact surface
6*a*, 6*b* Second transfer surface
7*a*, 7*b* Bearing surface
8 Slot
9 Segment
10 Sliding sleeve
11 Non-formed internal toothing system
12 Undercut
13 Stop tooth
14 Latching groove
15 Drive apparatus
16 Axial direction
17 Center longitudinal axis
18 Radial direction
19, 19*a*, 19*b* Drive element
20 Shaped relief
21 Inner surface
22 Working direction
23 Outer surface
24 Drive direction
25*a*, 25*b* Drive surface
26*a*, 26*b* Transfer surface
27 Tooth
28 Lateral tooth flank
29 Circumferential direction
30 Tip region
31 External toothing system
32 Root region
33 Main body
34, 35 Tip portion

The invention claimed is:

1. A method for forming a relief on a sintered workpiece, comprising:

moving a forming element having at least one forming relief in a radial working direction into contact with the surface of the sintered workpiece;

radially applying the at least one forming relief to the surface of the sintered workpiece; and creating a corresponding relief in the surface of the sintered workpiece having an inverse shape of the at least one forming relief of the forming element, wherein the surface of the sintered workpiece includes a toothing system comprising at least one tooth.

2. The method as set forth in claim 1, wherein moving the forming element further comprises varying the radial deflection of the forming element in the working direction to move the at least one forming relief into contact with the surface of the sintered workpiece.

3. The method as set forth in claim 2, wherein varying the radial deflection of the forming element comprises moving the forming element to a maximum radial deflection, wherein the corresponding relief is formed on a radially inner surface of the sintered workpiece.

4. The method as set forth in claim 2, wherein varying the radial deflection of the forming element comprises moving the forming element to a minimum radial deflection, wherein the corresponding relief is formed on a radially outer surface of the sintered workpiece.

5. The method as set forth in claim 1, wherein the surface of the sintered workpiece is a surface of at least one tooth of the toothing system.

6. The method as set forth in claim 5, wherein the surface of the at least one tooth is at least one of:

a lateral tooth flank facing an adjacent tooth;

a radially outer tip region; and a root region adjoining a main body of the at least one tooth.

7. The method as set forth in claim 6, wherein the corresponding relief in the surface of the sintered workpiece includes at least one of:

an undercut formed as a recess in the lateral tooth flank;

a latching groove formed as a recess in the outer tip region; and a stop tooth with at least two different tip portions in the outer tip region which extend to different radial lengths.

8. A method as set forth in claim 1, wherein the toothing system is an internal toothing system comprising one or more teeth disposed on an interior surface of the sintered workpiece.

9. New A method as set forth in claim 1, wherein the toothing system is an external toothing system comprising one or more teeth disposed on an exterior surface of the sintered workpiece.

10. The method as set forth in claim 1, wherein the sintered workpiece is a sliding sleeve for a shift transmission of a motor vehicle.

11. The method as set forth in claim 1, further comprising moving a drive element in a drive direction transverse to the radial working direction of the forming element, and wherein moving the drive element in the drive direction controls the movement of the forming element in the working direction.

12. The method as set forth in claim 11, wherein the drive direction is axial direction to the sintered workpiece.

13. The method as set forth in claim 11, wherein the drive element has a drive surface to transmit force from the drive element to the forming element.

14. The method as set forth in claim 13, wherein the drive surface is acutely positioned relative to the drive direction.

15. The method as set forth in claim 13, wherein moving the drive element in the drive direction transfers the force to a complementary transfer surface of a transfer element positioned between the drive element and the forming element.

16. The method as set forth in claim 15, wherein moving the drive element in the drive direction results in moving the transfer element in at least one of the radial working direction of the forming element and the drive direction of the drive element.

17. The method as set forth in claim 15, wherein the transfer element includes a first transfer surface contacting the drive element, and a second transfer surface contacting a complementary bearing surface of the forming element.

18. The method as set forth in claim 17, wherein the second transfer surface and the bearing surface run parallel to the drive direction of the drive element.

19. The method as set forth in claim 1, wherein the forming element contacts a transfer element having at least two transfer element parts transversely spaced apart from one another in the working direction, wherein each transfer element part has a first transfer surface contacting the drive element and a second transfer surface contacting a bearing surface of the forming element.

20. A method for using a tool for forming a relief on a surface of a sintered workpiece, comprising:

radially deflecting a forming element toward the sintered workpiece, wherein the forming element has at least one forming relief facing the surface of the sintered workpiece;

impressing the at least one forming relief at least partially into a surface of the sintered workpiece; and removing the at least one forming relief of the forming element from contact with the sintered workpiece, revealing a sintered workpiece having a corresponding relief formed in the surface.

* * * * *